US008100176B2

(12) United States Patent
Minescu et al.

(10) Patent No.: US 8,100,176 B2
(45) Date of Patent: Jan. 24, 2012

(54) DEVICE FOR REMOVING LIQUIDS FROM THE WELL-BORE OF A GAS PRODUCING WELL

(76) Inventors: Florea Minescu, Ploiesti (RO); Valentin Ispas, Sammamish, WA (US)

( * ) Notice: Subject to any disclaimer, the term of this patent is extended or adjusted under 35 U.S.C. 154(b) by 311 days.

(21) Appl. No.: 12/583,493

(22) Filed: Aug. 21, 2009

(65) Prior Publication Data

US 2011/0042062 A1 Feb. 24, 2011

(51) Int. Cl.
*E21B 43/00* (2006.01)
*E21B 43/38* (2006.01)
*E21B 43/40* (2006.01)

(52) U.S. Cl. ..... 166/105.6; 417/120; 417/137; 417/118

(58) Field of Classification Search ..... 166/369, 166/370, 372, 105.5, 105.6; 417/118, 120, 417/137

See application file for complete search history.

(56) References Cited

U.S. PATENT DOCUMENTS 5,992,521 A * 11/1999 Bergren et al. ..... 166/265
6,260,619 B1 * 7/2001 Svedeman et al. ..... 166/265
6,494,258 B1 * 12/2002 Weingarten ..... 166/265

FOREIGN PATENT DOCUMENTS

RO A 2008 00264 9/2009
WO WO 2011/010944 A1 1/2011

* cited by examiner

*Primary Examiner* — William P Neuder
*Assistant Examiner* — Cathleen Hutchins
(74) *Attorney, Agent, or Firm* — Anthony Claiborne

(57) ABSTRACT

A device for liquid removal from a drilled hole equipped for gas production from an underground accumulation, under the conditions in which a downward liquid film flow on the tubing string wall occurs, the device comprising a long lower inner liner (4) whose upper end (b) is beveled, surrounded by an "M"-shaped short-circuiting pipe (7), provided with short vertical portions (j and k), which, at the lower side, are secured to elbows (l and m) of an "M"-shaped discharge path (8) which partially surrounds the lower inner liner, the elbows continuing to the lower side with long vertical portions (n and o) and short vertical portions (p and q) which communicate between them through a lower horizontal portion (r), one long vertical portion having a curved lower end (s) mounted in a window (t) cut into the lower inner liner and the other long vertical portion having an open end (u) located in an accumulation chamber (a).

2 Claims, 1 Drawing Sheet

DEVICE FOR REMOVING LIQUIDS FROM THE WELL-BORE OF A GAS PRODUCING WELL

BACKGROUND OF THE INVENTION

1. Field of the Invention

The invention relates to a device for liquid removal from a drilled hole equipped for gas production from an underground accumulation, under the conditions in which a downward liquid film flow on the tubing string wall occurs.

2. Description of the Related Art

There are known devices for removal of fluids from a drilled hole, in the conditions in which a two-phase flow occurs, equipped for natural gas production, consisting of upper short liner and lower long liner, so that it remains a free space between a lower flared end of the short liner and an upper end of the long liner, to the long liner there being secured, at the lower side, a cylindrical housing integral, in its turn being fixed, at the upper side, with a connection joint to the short liner, between the housing and the liners there remaining an annular space in which the liquid slips through the free space, to the long liner, in front of an orifice machined therein, there being secured either a siphoning pipe located inside the annular space or a non-balanced gas-lift valve.

The disadvantages of these devices consist in that they permit the removal of only a relatively low liquid volume, due to the low differential pressure; there also exhibits the possibility of failing to initiate the discharge of the fluid accumulated into the chamber when the differential pressure is very low, within few centimeters of water column.

Surprisingly, it has been found that by simultaneously creating a differential hydrostatic pressure between the upper liquid level in a liquid accumulation chamber, in which the liquid gathered from the downward flowing film, as a part of the total liquid quantity of the two-phase mixture flowing upward and the upper level of the liquid in a siphoning path with a configuration allowing the creation of a trapped gas volume, and between the upper and the lower liquid levels in the siphoning path, respectively, and at the same time, between the levels of a liquid column in a short-circuiting pipe with a configuration allowing the controlled removal of the active trapped gas volume which is in a hydrodynamic communication with the siphoning pipe, produces the pressure change of the trapped gas volume between the upper and lower liquid levels in the siphoning path, and the level of one of the free surfaces of the liquid column in the short-circuiting pipe, which creates the conditions for a controlled flow initiation from the accumulation chamber into the tubing string, leading to the accumulation chamber's discharge.

The trapped gas whose pressure and volume vary with the increase of the liquid level in the accumulation chamber, provides a controlled liquid removal from the accumulation chamber as long as the short-circuiting pipe has a relatively reduced remnant liquid volume, and the liquid column levels are inside of some spaces whose volumes exceed the remnant liquid volume by at least 50%.

The problem solved by the device claimed by the invention consists in the control of the liquid removal from an accumulation chamber inserted a gas flow tubing string, until it is completely discharged.

BRIEF SUMMARY OF THE INVENTION

The device claimed by the invention eliminates the disadvantage shown before by the fact that, the proximity of upper beveled end of a lower inner liner is surrounded by a letter "M"-shaped short-circuiting pipe, provided with some short vertical portions, whose lower sides are secured to some elbows of an "M"-shaped discharge path which partially surrounds the lower inner liner, the specified elbows continuing downwards with some long vertical portions, as well as with some short vertical portions, which, in their turn, communicate between them through a lower horizontal portion, the long vertical portions having a lower curved end mounted in a window cut in the lower inner liner, and an open end located in the accumulation chamber, respectively.

Another technical characteristic of the device claimed by the invention consists in that the short-circuiting pipe has a horizontal portion of a capillary like size, continued by some larger portions, each of them having a volume close to the remnant liquid volume of the horizontal portion, continued by some elbows with two short vertical portions.

According to the invention, the device presents the following advantages:

- ensures catching the liquid that is moving downwards on the inner wall of the tubing string and a controlled liquid removal from the accumulation chamber into the tubing string;
- presents reliability in operation;
- does not require energy consumption;
- does not change the inner geometry of the tubing string;
- does not have moving parts to lead to accidental blockages and no workovers needs;
- has a relatively simple construction, not requiring additional rigging-up for its mounting and running with the tubing string into the drilled hole.

BRIEF DESCRIPTION OF THE DRAWING

The foregoing objects, as well as further objects, advantages, features and characteristics of the present invention, in addition to methods of operation, function of related elements of structure, and the combination of parts and economies of manufacture, will become apparent upon consideration of the following description and claims with reference to the accompanying drawing, all of which form a part of this specification, and wherein:

DETAILED DESCRIPTION OF THE INVENTION

Figure 1:
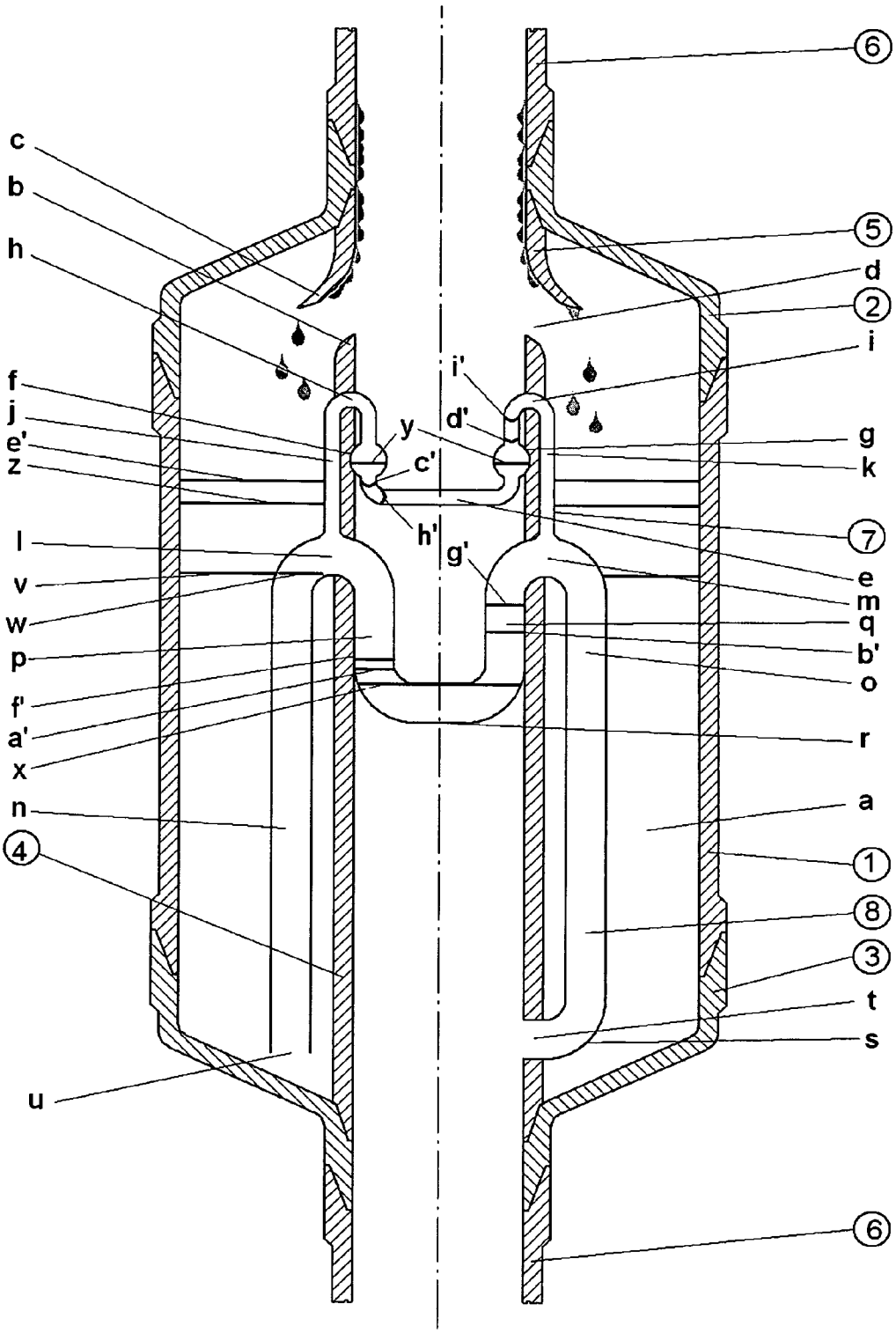
FIG. 1 is a cross-sectional view of an embodiment of the present invention.

Following is an example of the embodiment of the device according to the invention as shown in the FIGURE representing the construction and operational schema of the device.

According to the invention, the device consists of an outer liner 1 which, together with some joints 2 and 3, upper and lower, respectively and a long lower inner liner 4, forms an accumulation chamber a preferably having a similar volume to the one internally confined by the liner 4. The liner 4 is secured at the lower side, preferably by screwing, to the joint 3 and has an outwardly beveled upper end b in the proximity of which there is located an outwardly flared lower end c of a short upper inner liner 5 mounted to the upper side by screwing in the joint 2. The chamber a communicates to the upper side, with a tubing string 6, through a space d confined by the end b and the end c, respectively. The liners 1, 4, and 5 are located coaxially with the tubing string 6 and the inside diameter of the liners 4 and 5 is preferably equal to the inside diameter of the tubing string 6. Near the end b, at the outer side of the liner 4, there is located a "M"-shaped short-circuiting pipe 7 with capillary like cross section and partially surrounds the liner 4. The pipe 7 has a lower horizontal portion e which communicates with some large portions f and g, of same volume, each of these volumes being close to the volume of portion e. The portions f and g communicate, through some upper elbows h and i, with some vertical portions j and k. The lower ends of these last portions represent the joint between the pipe 7 and a siphoning path 8 on top of the upper elbows l and m which connect them with some long vertical portions n and o. The "M"-shaped path 8 has an adequate cross-section geometry, which allows it to be placed into the chamber a and partially surrounds the liner 4 on its outer side. The elbows l and m are also connected with some short vertical portions p and q which communicate through a lower horizontal portion r. The portion n has a lower end s curved towards the axis of the tubing string 6, which is secured in a window t cut in the liner 4, in the proximity of the joint 3. A lower open end u of the portion o communicates with the chamber a very close to the joint 3.

Following is an example of the embodiment of the device according to the invention, which has a total length, for example, of the order of 10 m, a diameter of the outer liner 1, for example, of the order of 100-150 mm and an inner diameter of the liners 4 and 5, for example, of the order of 50-60 mm, all the dimensions being adapted to the drilled hole completion and to the flow parameters.

During the upward flow of the two-phase gas-liquid mixture through the tubing string 6, a downward moving liquid film is formed on the wall of the tubing string 6, which is directed, through the flared end c of the short upper inner pipe 5, into the chamber a wherein it is accumulated until reaching a level v, the same as a level w in the portion n of the path 8, when the liquid starts to flow into the horizontal portion r through the vertical portion p. Until the horizontal portion r is filled with liquid so that a maximum level x is reached, the liquid level v in chamber a and the level w in the portion m remain constant and a level v of the remnant liquid volume in the pipe 7 has the same value in the two portions f and g. The filling of the horizontal portion r leads to the formation of a trapped gas volume delimited by the liquid surfaces positioned at a level x in the portion r, a level w in the portion m and at a level y in the portion f, the trapped gas having an initial pressure assumed to be equal to the pressure in the tubing string 6 in d space aria. While the liquid flow into the accumulation chamber a continues, the liquid level v therein increases up to an intermediate level z and the liquid level in portion p will increase up to an intermediate level a' and in the portion q up to an intermediate level b' and in the pipe 7 there will be induced the same difference between liquid levels as the one between the portions p and q, namely a level c' is reached in portion f and a level d' is reached in the portion q, and the pressure of the trapped gas will increase. The difference between the levels w and a', and between the levels y and c', respectively is smaller than the one between the levels z and v by a value equal to the height of a liquid column equivalent to the difference between the pressure at this moment and the initial pressure of the trapped gas. To an upper liquid level e' in the chamber a corresponds a liquid level f' in the portion p and a level g' in the portion q, and in the pipe 7 corresponds a liquid-gas interface h' at the inlet in the horizontal portion e and another liquid-gas interface i' in the portion g. From this moment the interface h' moves into the portion e until it reaches into the portion g, when the trapped gas starts slipping through the liquid plug in the portion g, which makes the trapped gas behind the interface h' gradually reduce its volume until it vanishes, the siphoning path 8 becoming full of liquid up to the region of elbow 1, positioned at a level lower than the liquid level e', being generated the proper conditions for starting the liquid siphoning from the chamber a through the siphoning path 8 and, to a lower extent in accordance with the flow section, through the pipe 7 into the tubing string 6 until emptying the chamber a in front of the portion o. Finally, in the pipe 7 remains a liquid stock higher than the volume of the horizontal portion e as a result of the fact that the liquid in the large portion g is not displaced by the gas entering the siphoning path 8.

While the chamber a is emptying, the liquid-gas ratio in the space above the exit t increases by at least ten times higher then the average liquid-gas ratio, which generates flow rate regime with a higher liquid lifting efficiency.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

We claim:

1. A device for liquid removal from a drilled hole equipped for gas production from an underground accumulation, comprising:

an outer cylindrical liner (1) secured at the outer cylindrical liner's upper end (2) and lower end (3) by means of joints within a gas flow tubing string (6);

a pair of inner cylindrical liners (4, 5) secured within the outer cylindrical liner, the inner cylindrical liners comprising:

a long lower liner (4) having a beveled upper end (b) and secured by a junction at a lower end of the long lower liner to the outer cylindrical liner near the lower end of the outer cylindrical liner, thereby forming an accumulation chamber (a) between the lower liner and the outer cylindrical liner; and a short upper liner (5) having an outwards flared lower end (e) and secured by a junction at an upper end of the long lower liner to the outer cylindrical liner near the upper end of the outer cylindrical liner, the inner cylindrical liners disposed within the outer cylindrical liner to leave a space (d) between the upper end of the lower liner and the lower end of the upper liner, the space communicating with the accumulation chamber;

a letter "M"-shaped short-circuiting pipe (7) passing around the outside of the lower inner liner in the proximity of and below the upper end of the lower inner liner, the short-circuiting pipe comprising short vertical portions (j, k) secured to and communicating at their lower ends with elbows (1, m), of a letter "M"-shaped discharge path (8) passing around the outside of the lower inner liner, the elbows communicating by short inner vertical portions (p, q) and a short horizontal portion (r), the first elbow (m) further communicating by a first long vertical portion (o) connected to curved end (s) through window (t) in the lower inner liner to the gas flow tubing string, and the second elbow (l) communicating by a second long vertical portion (n) to the accumulation chamber.

2. The device according to claim 1, wherein the short-circuiting pipe 7 further comprises a thin horizontal portion (e) of capillary size, each end of which is connected to and communicating with an expansion portion (f, g), each expansion portion having an interior volume close to the interior volume of the thin horizontal portion, each expansion portion further connected to and communicating through an elbow (h, i) to one of the short vertical portions (j, k) of the short-circuiting pipe.

* * * * *